US006062708A

United States Patent [19]

Chen

[11] Patent Number: 6,062,708

[45] Date of Patent: May 16, 2000

[54] DECORATION LAMP STRING DEVICE

[76] Inventor: Wei-Sheng Chen, NO. 56, Min Sheng Street, Feng-Yuan City 420, Taiwan

[21] Appl. No.: 09/148,887

[22] Filed: Sep. 8, 1998

[51] Int. Cl.[7] ..... F21P 1/00

[52] U.S. Cl. ..... 362/252; 362/806; 315/185 S

[58] Field of Search ..... 362/231, 230, 362/251, 250, 252, 806, 810, 295, 394; 315/71, 185 S, 185 R, 200 A, 56, 58; 439/419, 611, 699.2; 313/318.05, 318.06

[56] References Cited

U.S. PATENT DOCUMENTS

| | | | |
|---|---|---|---|
| 5,379,202 | 1/1995 | Duan | 362/252 |
| 5,828,183 | 10/1998 | Wang | 315/185 S |
| 5,942,857 | 8/1999 | Hsu | 315/185 S |

*Primary Examiner*—Sandra O'Shea
*Assistant Examiner*—Hargobind Sawhney

[57] ABSTRACT

A decoration lamp string device has a lamp type control device, a plug, and a lamp string. The lamp type control device has a bulb type main body, a lamp holder receiving the bulb type main body, and a socket receiving the lamp holder. An electric circuit is disposed in the bulb type main body. A plurality of lead-in wires are extended from an interior of the bulb type main body. A first electric wire is connected to the plug and the socket. A second electric wire is connected to the plug and the lamp string. The lamp string has a plurality of decoration lamps, a third electric wire, and a fourth electric wire. A first copper post is connected to the first lead-in wire. A second copper post is connected to the second lead-in wire. A third copper post is connected to the third lead-in wire.

2 Claims, 13 Drawing Sheets

DECORATION LAMP STRING DEVICE

BACKGROUND OF THE INVENTION

This invention relates to a decoration lamp string device, and more particularly, this invention relates to a multi-circuit type decoration lamp string device.

Referring to FIGS. 1 to 3, a conventional decoration lamp string device has a flasher bulb 22, a plurality of sockets 20, and an electric wire 10 connected to the flasher bulb 22 and the sockets 20. Each socket 20 receives a lamp 22. The flasher bulb 22 has a first filment 221, a second filment 222, and an elastic conductive plate 223. The elastic conductive plate 223 is connected to the first filment 221. The elastic conductive plate 223 contacts the second filment 222. When the temperature of the elastic conductive plate 223 is increased, the elastic conductive plate 223 will be expanded so that the elastic conductive plate 223 will not contact the second filment 222. Therefore, a short circuit is formed. When the temperature of the elastic conductive plate 223 is decreased to a certain degree, the elastic conductive plate 223 will be contracted so that the elastic conductive plate 223 will contact the second filment 222 again. If the weather is cold, the thermal expansion period of the elastic conductive plate 223 will be extended and the thermal contraction period of the elastic conductive plate 223 will be shortened. Therefore, the interval between two glittering period will be changed. Further, the elastic conductive plate 223 is easily damaged under strong vibration. Thus the usage period of time of the conventional decoration lamp string device is shortened.

Referring to FIGS. 4 and 4A, an electric circuit of the first conventional decoration lamp string device is illustrated. An integrated circuit control box 24 is disposed between an upper cover 244 and a lower container 245. The integrated circuit control box 24 has a bridge-type rectification formed by four rectifiers D1, D2, D3 and D4, a first resistor R1 as a voltage-decreasing resistor, an integrated circuit IC, a second resistor R2 providing 60 HZ of electric source for the integrated circuit IC, a capacitor C1 as a wave filter capacitor, a button switch K1 connected to the integrated circuit IC, an electric wire 242 connected to the integrated circuit IC and a plurality of decoration lamps 243, and a plug 241 connected to the integrated circuit IC. The electric circuit has three circuit loops.

Referring to FIGS. 5 and 5A, a second electric circuit is illustrated. An integrated circuit control box 25 is disposed between an upper cover 254 and a lower container 255. The integrated circuit control box 25 has a bridge-type rectification formed by four rectifiers D1, D2, D3 and D4, a first resistor R1 as a voltage-decreasing resistor, an integrated circuit IC, a second resistor R2 providing 60 HZ of electric source for the integrated circuit IC, a capacitor C1 as a wave filter capacitor, a button switch K1 connected to the integrated circuit IC, a wire 252 connected to the integrated circuit control box 25 and a plurality of decoration lamps 253, and a plug 251 connected to the integrated circuit IC. The electric circuit has five circuit loops. However, it is difficult to assemble the integrated circuit control box with integrated circuit therein. The volume of the integrated circuit control box is too large, so it is difficult to replace the integrated circuit control box if it is broken.

SUMMARY OF THE INVENTION

An object of the invention is to provide a decoration lamp string device which can be glittered without any flasher bulb.

Accordingly, a decoration lamp string device comprises a lamp type control device, a plug, and a lamp string. The lamp type control device comprises a bulb type main body, a lamp holder receiving the bulb type main body, and a socket receiving the lamp holder. An electric circuit is disposed in the bulb type main body. A first lead-in wire, a second lead-in wire, and a third lead-in wire are extended from an interior of the bulb type main body. A first electric wire is connected to the plug and the socket. A second electric wire is connected to the plug and the lamp string. The lamp string comprises a plurality of decoration lamps, a third electric wire, and a fourth electric wire. A first copper post is connected to the first lead-in wire and the first electric wire. A second copper post is connected to the second lead-in wire and the third electric wire. A third copper post is connected to the third lead-in wire and the fourth electric wire.

DETAILED DESCRIPTION OF THE INVENTION

Figure 1:
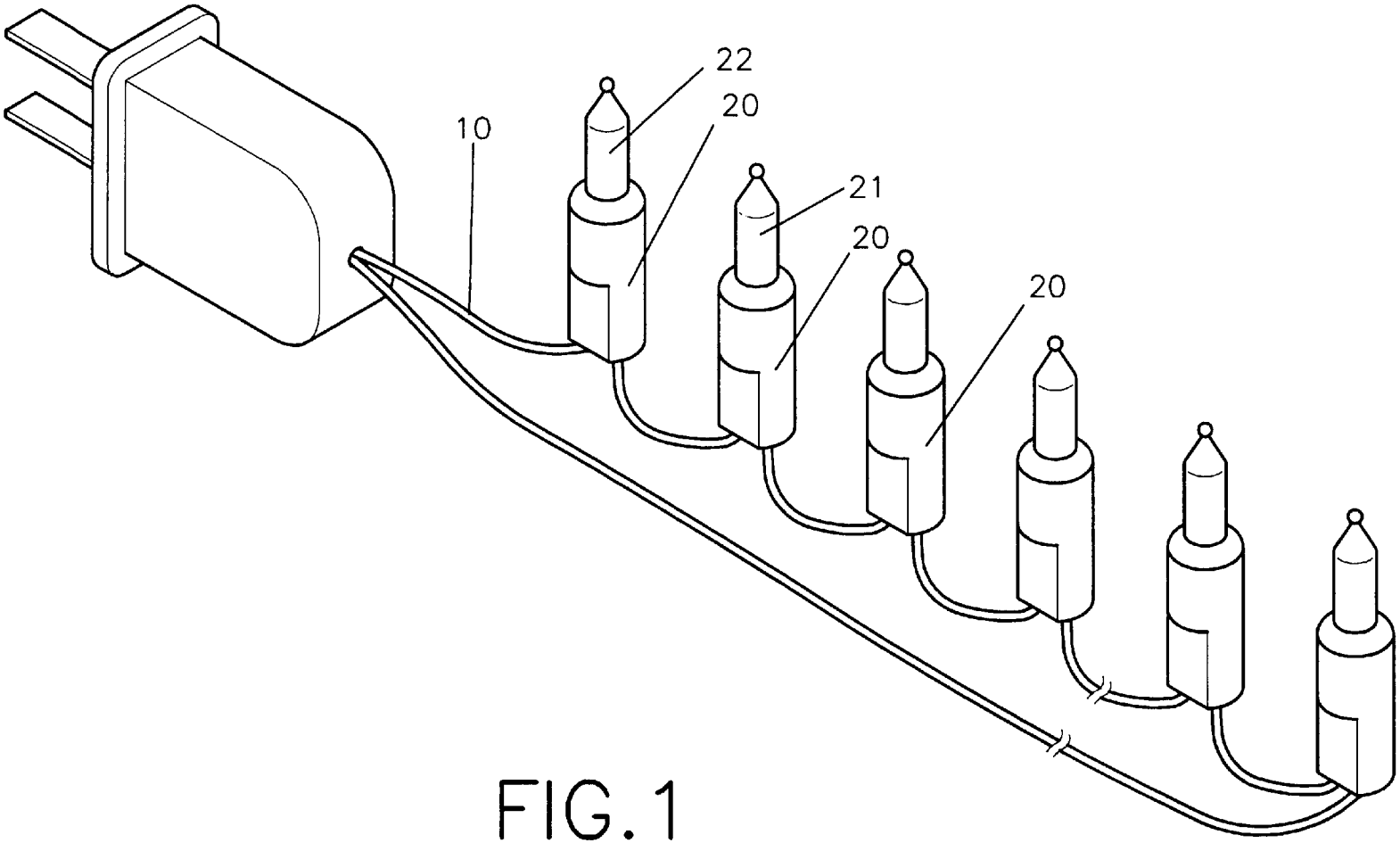
FIG. 1 Prior Art
FIG. 1 is a perspective view of a decoration lamp string device of the first prior art.
Figure 2:
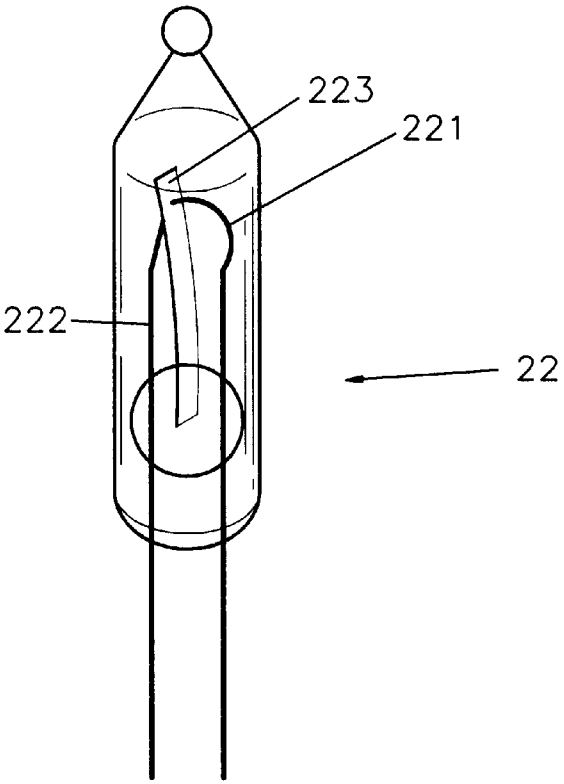
FIG.2 Prior Art
FIG. 2 is a perspective view of a flasher bulb of the first prior art.
Figure 3:
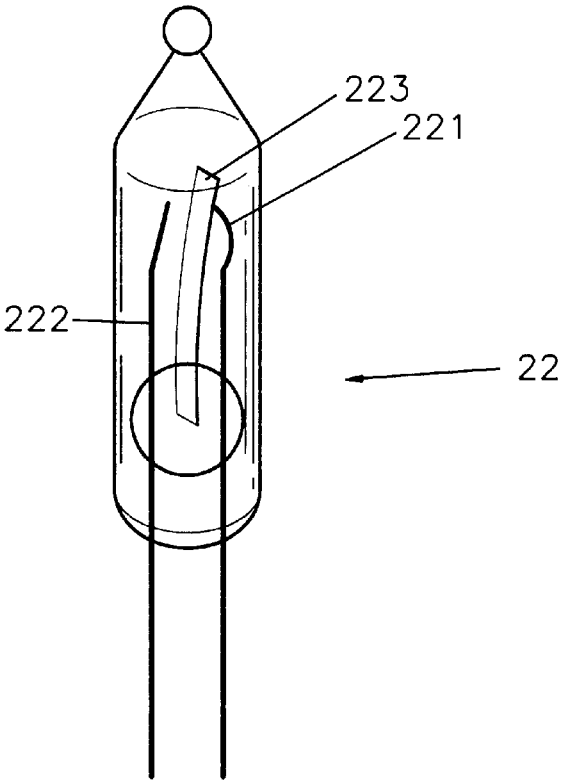
FIG.3 Prior Art
FIG. 3 is another perspective view of a flasher bulb of the first prior art.
Figure 4:
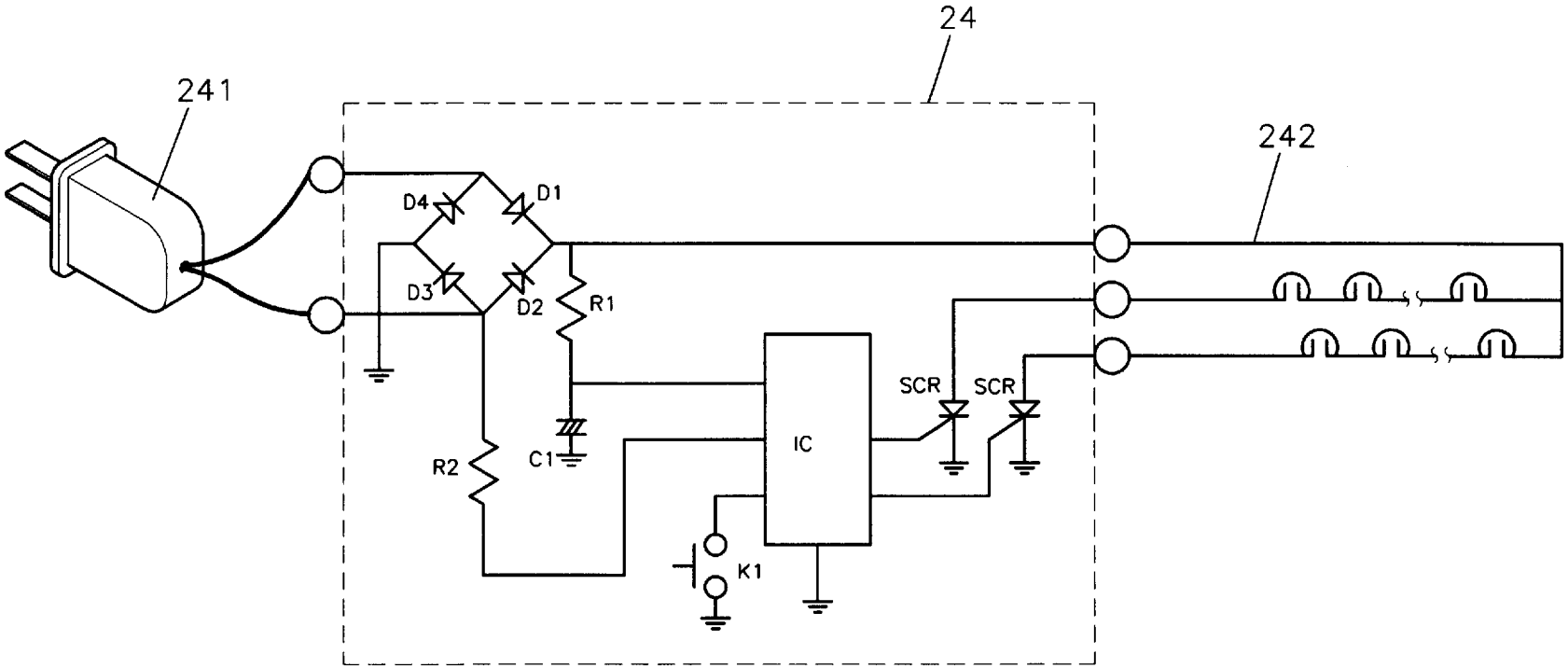
FIG. 4 Prior Art
FIG. 4 is an electric schematic view of an electric circuit of a decoration lamp string device of the first prior art.
Figure 4A:
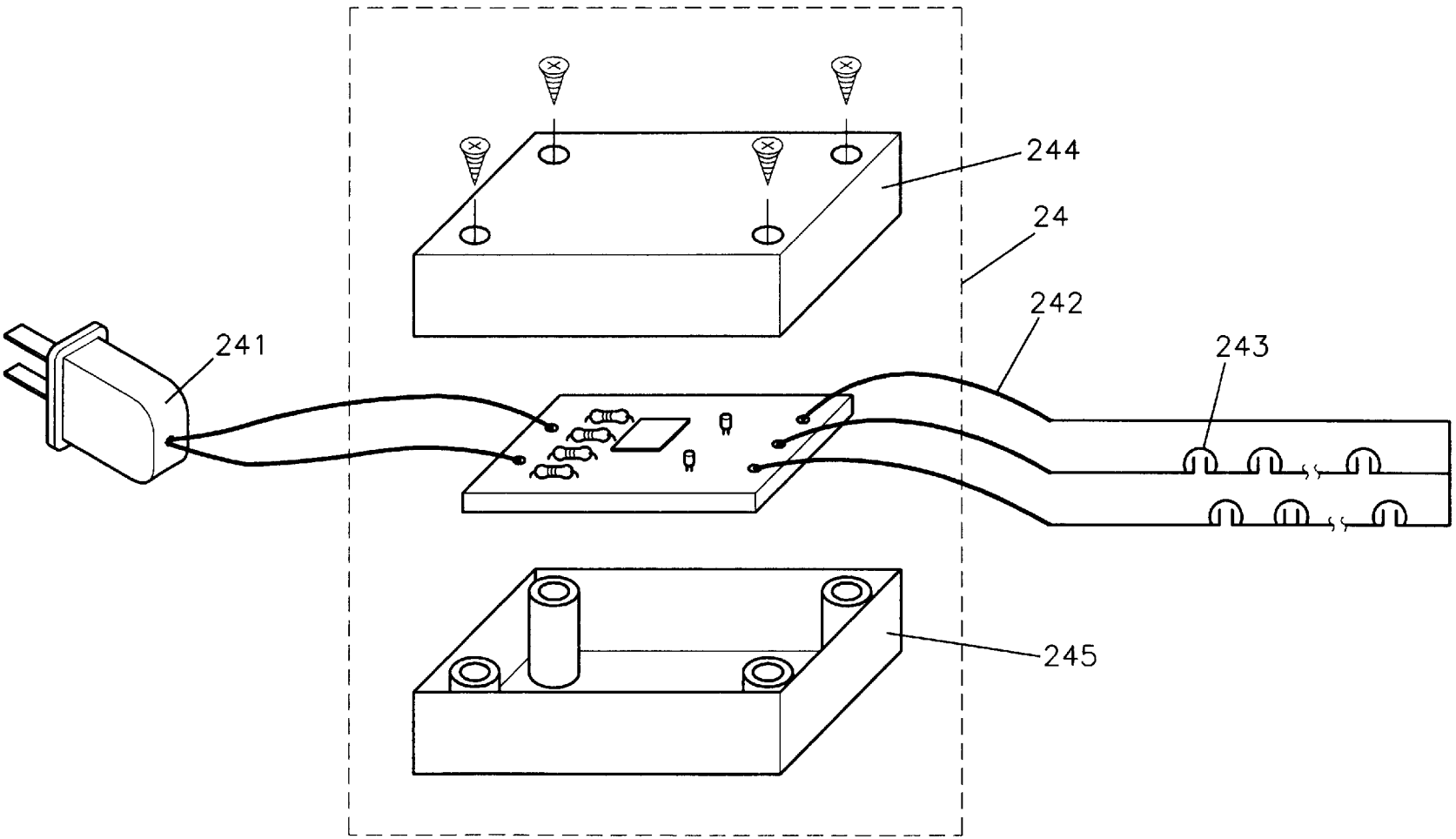
FIG. 4A Prior Art
FIG. 4A is an electric schematic view of an electric circuit of a decoration lamp string device of the first prior art with a perspective exploded view of an integrated circuit control box.
Figure 5:
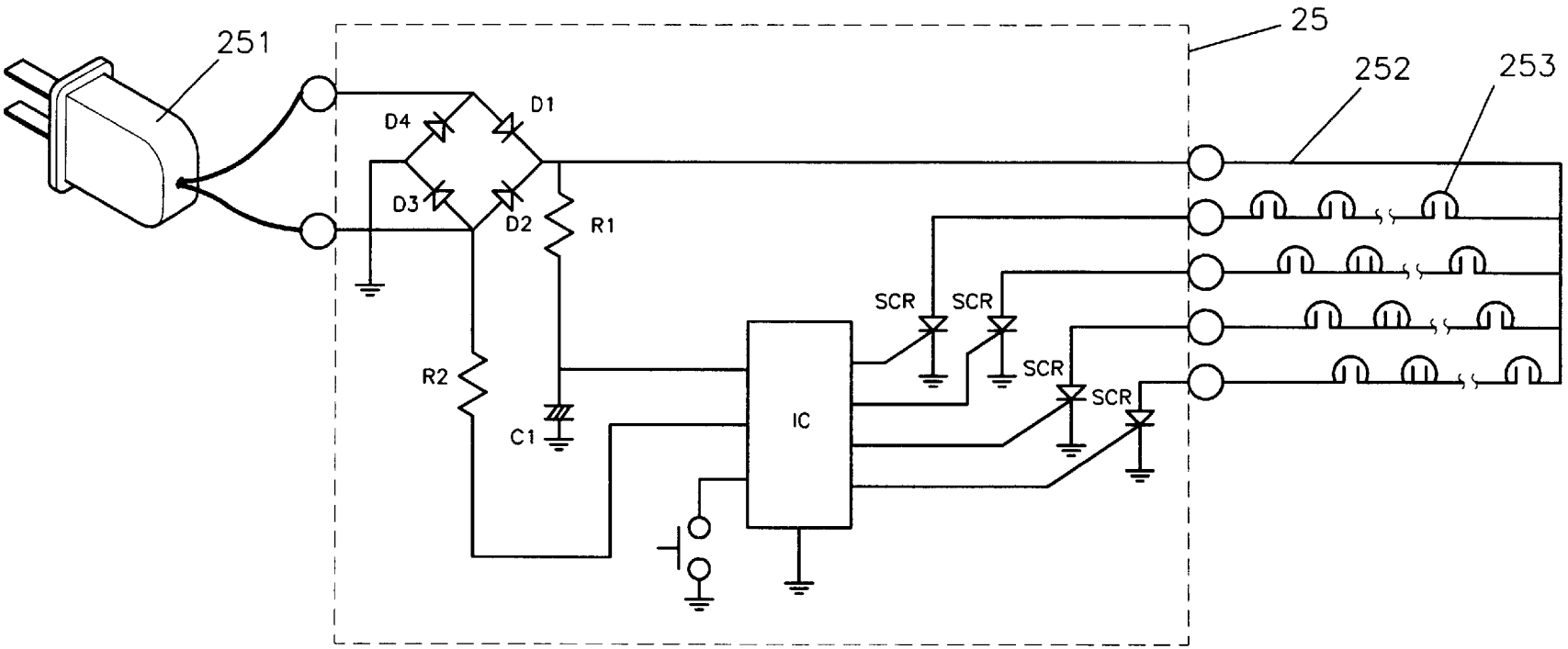
FIG.5 Prior Art
FIG. 5 is an electric schematic view of an electric circuit of a decoration lamp string device of the second prior art.
Figure 5A:
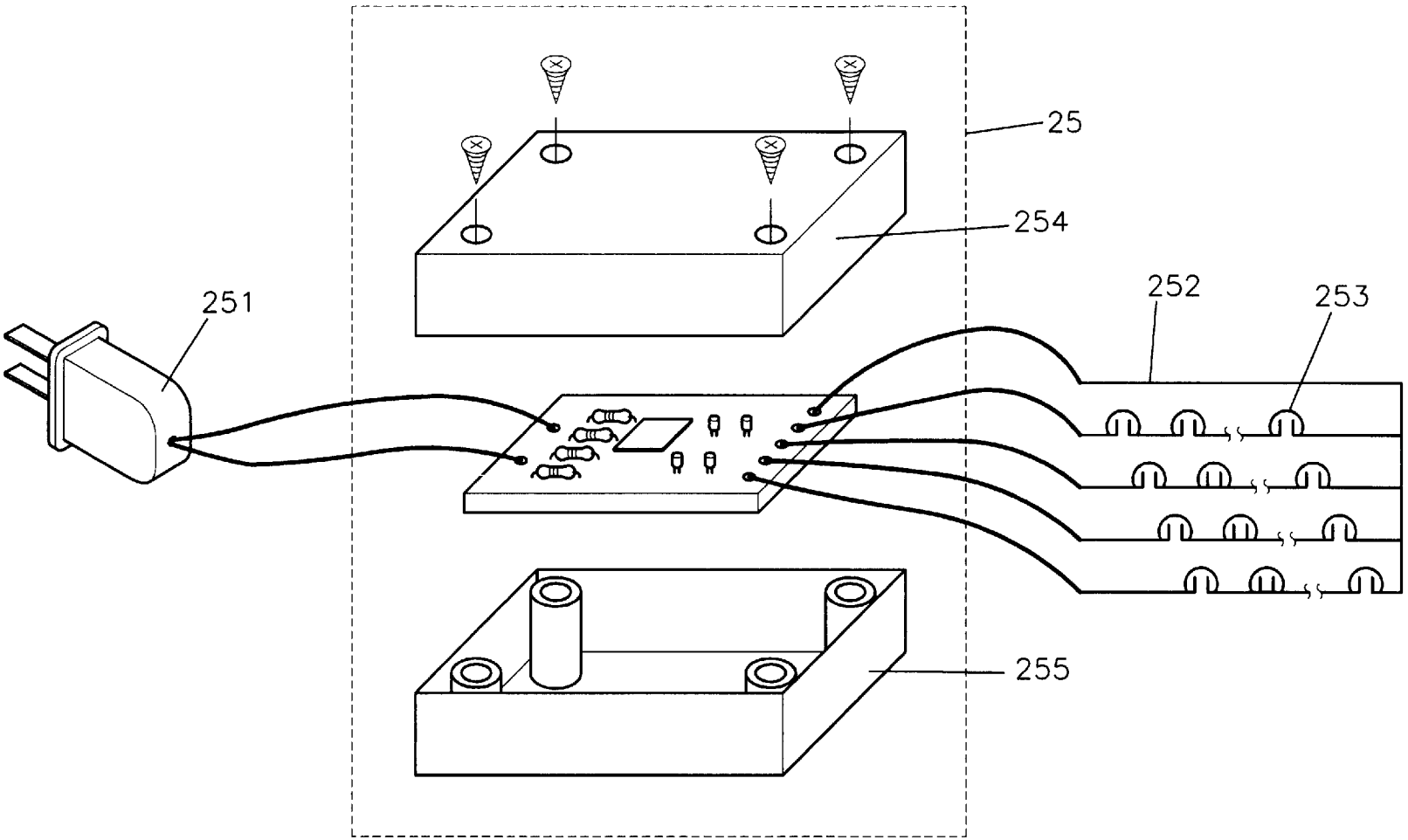
FIG.5A Prior Art
FIG. 5A is an electric schematic view of an electric circuit of a decoration lamp string device of the second prior art with a perspective exploded view of an integrated circuit control box.
Figure 6:
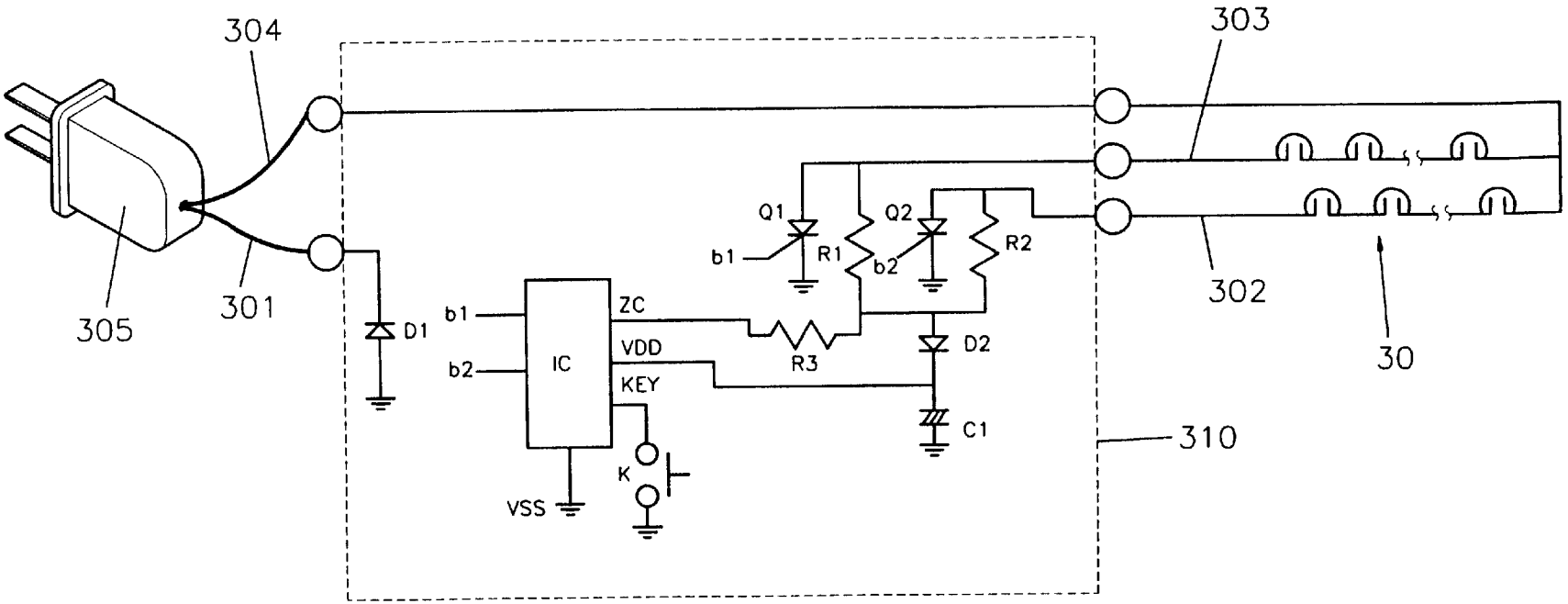
FIG. 6 is an electric schematic view of an electric circuit of a decoration lamp string device of a first preferred embodiment.
Figure 6A:
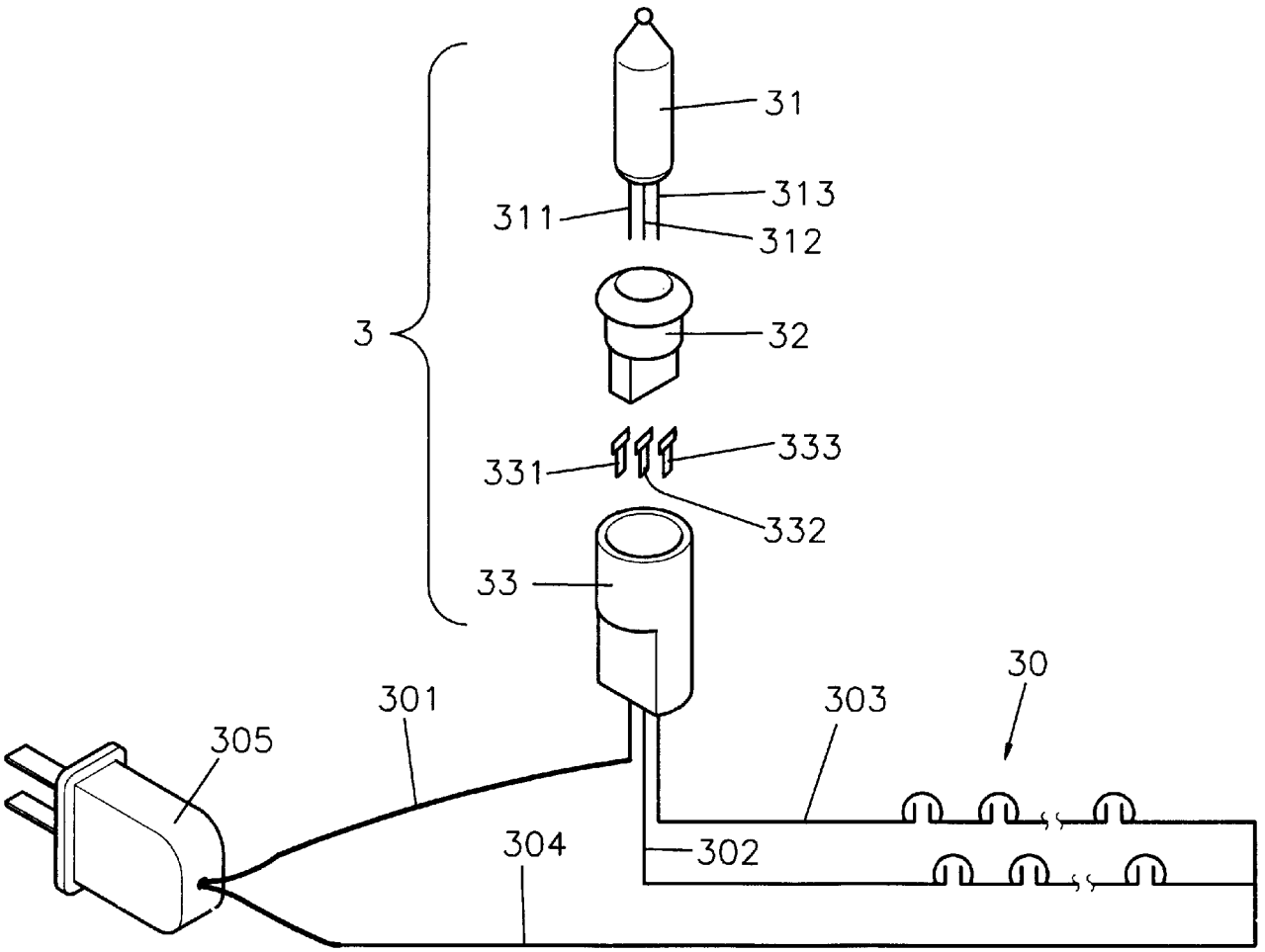
FIG. 6A is an electric schematic view of an electric circuit of a decoration lamp string device of a first preferred embodiment with a perspective exploded view of a bulb-type control device.

Referring to FIGS. 6 and 6A, a first decoration lamp string device comprises a lamp type control device 3, a plug 305, and a lamp string 30.

The lamp type control device 3 comprises a bulb type main body 31, a lamp holder 32 receiving the bulb type main body 31, and a socket 33 receiving the lamp holder 32. An electric circuit 310 is disposed in the bulb type main body 31. A first lead-in wire 311, a second lead-in wire 312, and a third lead-in wire 313 are extended from an interior of the bulb type main body 31.

A first electric wire 301 is connected to the plug 305 and the socket 33. A second electric wire 304 is connected to the plug 305 and the lamp string 30.

The lamp string 30 comprises a plurality of decoration lamps, a third electric wire 302, and a fourth electric wire 303.

A first copper post 331 is connected to the first lead-in wire 311 and the first electric wire 301. A second copper post 332 is connected to the second lead-in wire 312 and the third electric wire 302. A third copper post 333 is connected to the third lead-in wire 313 and the fourth electric wire 303.

The electric circuit comprises an integrated circuit IC, a first rectifier D1 as a half-wave rectification, a second rectifier D2 as a half-wave rectification providing an voltage for the integrated circuit IC, a first silicon control rectifier Q1, a second silicon control rectifier Q2, a ZC symbol providing 60 HZ of electric source for the integrated circuit IC, a capacitor C1 as a wave filter capacitor, a button switch K connected to the integrated circuit IC, a VDD symbol providing positive voltage for the integrated circuit IC, a VSS symbol providing negative voltage for the integrated circuit IC, a KEY symbol selecting various flash functions, a b1 symbol providing an operation signal for the rectifiers, and a b2 symbol providing a non-operation signal for the rectifiers.

Figure 7:
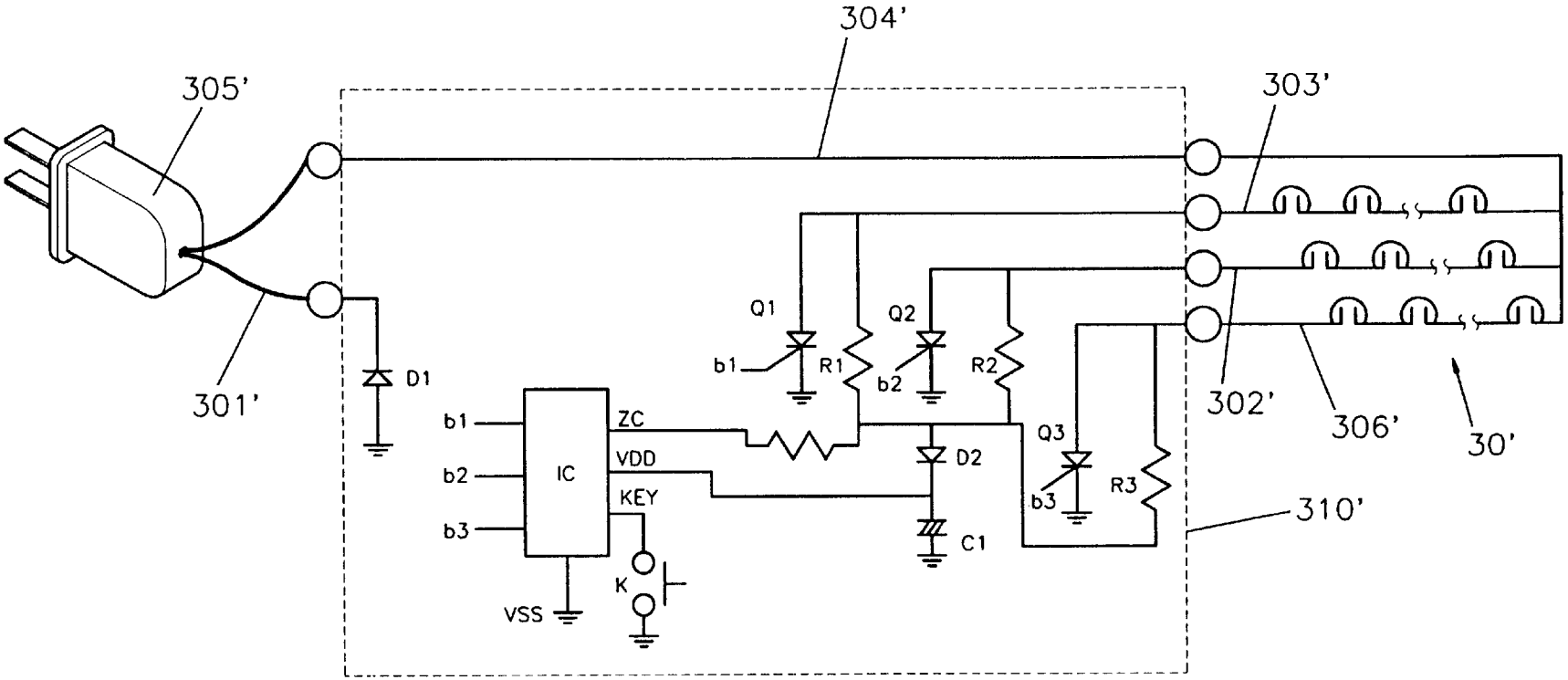
FIG. 7 is an electric schematic view of an electric circuit of a decoration lamp string device of a second preferred embodiment.
Figure 7A:
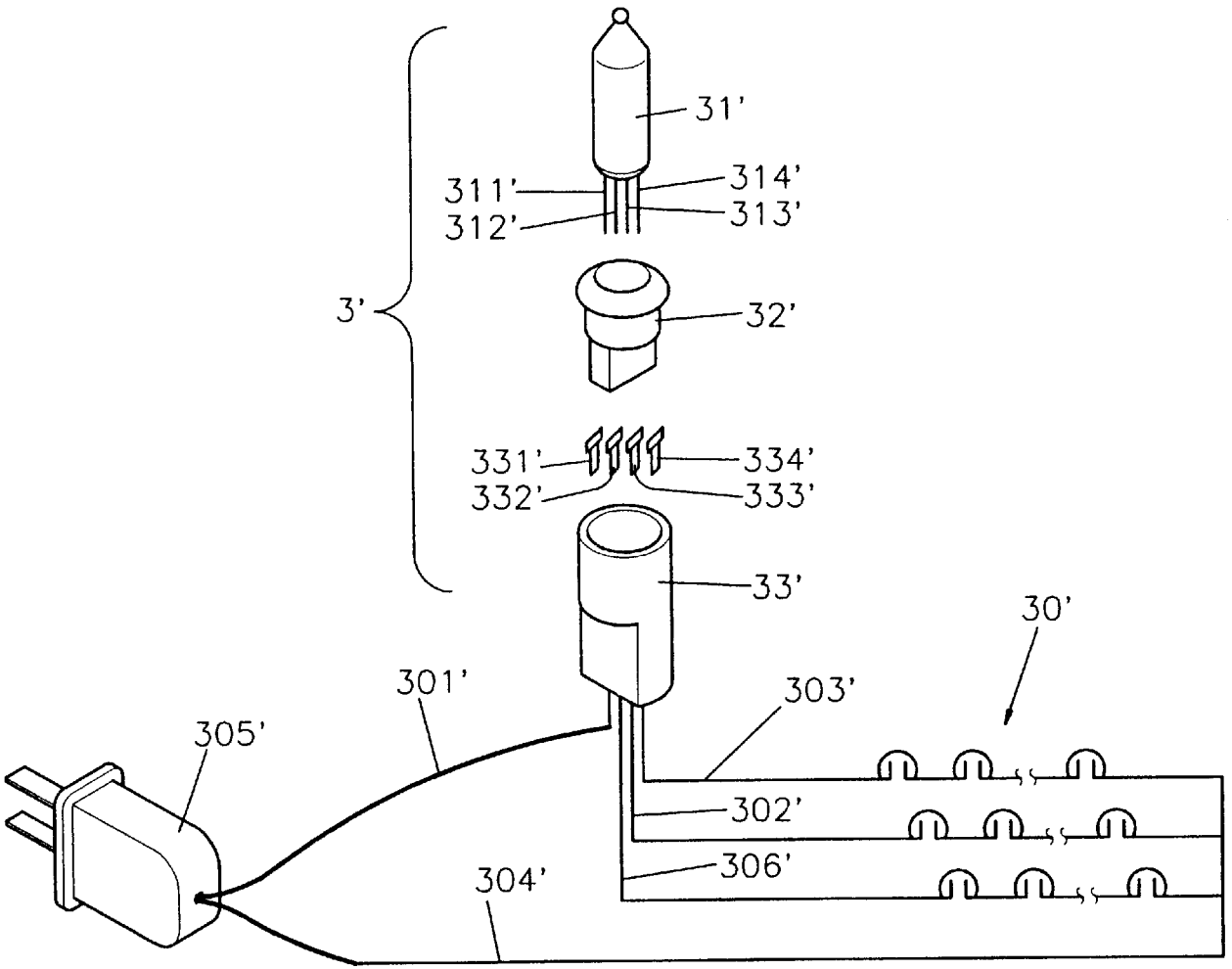
FIG. 7A is an electric schematic view of an electric circuit of a decoration lamp string device of a second preferred embodiment with a perspective exploded view of a bulb-type control device.

Referring to FIGS. 7 and 7A, a second decoration lamp string device comprises a lamp type control device 3', a plug 305', and a lamp string 30'.

The lamp type control device 3' comprises a bulb type main body 31', a lamp holder 32' receiving the bulb type main body 31', and a socket 33' receiving the lamp holder 32'. An electric circuit 310' is disposed in the bulb type main body 31'. A first lead-in wire 311', a second lead-in wire 312', a third lead-in wire 313, and a fourth lead-in wire 314' are extended from an interior of the bulb type main body 31'.

A first electric wire 301' is connected to the plug 305' and the socket 33'. A second electric wire 304' is connected to the plug 305' and the lamp string 30'.

The lamp string 30' comprises a plurality of decoration lamps, a third electric wire 302', and a fourth electric wire 303', and a fifth electric wire 306'.

A first copper post 331' is connected to the first lead-in wire 311' and the first electric wire 301'. A second copper post 332' is connected to the second lead-in wire 312' and the third electric wire 302'. A third copper post 333' is connected to the third lead-in wire 313' and the fourth electric wire 303'. A fourth copper post 334' is connected to the fourth lead-in wire 314' and the fifth electric wire 306'.

Figure 8:
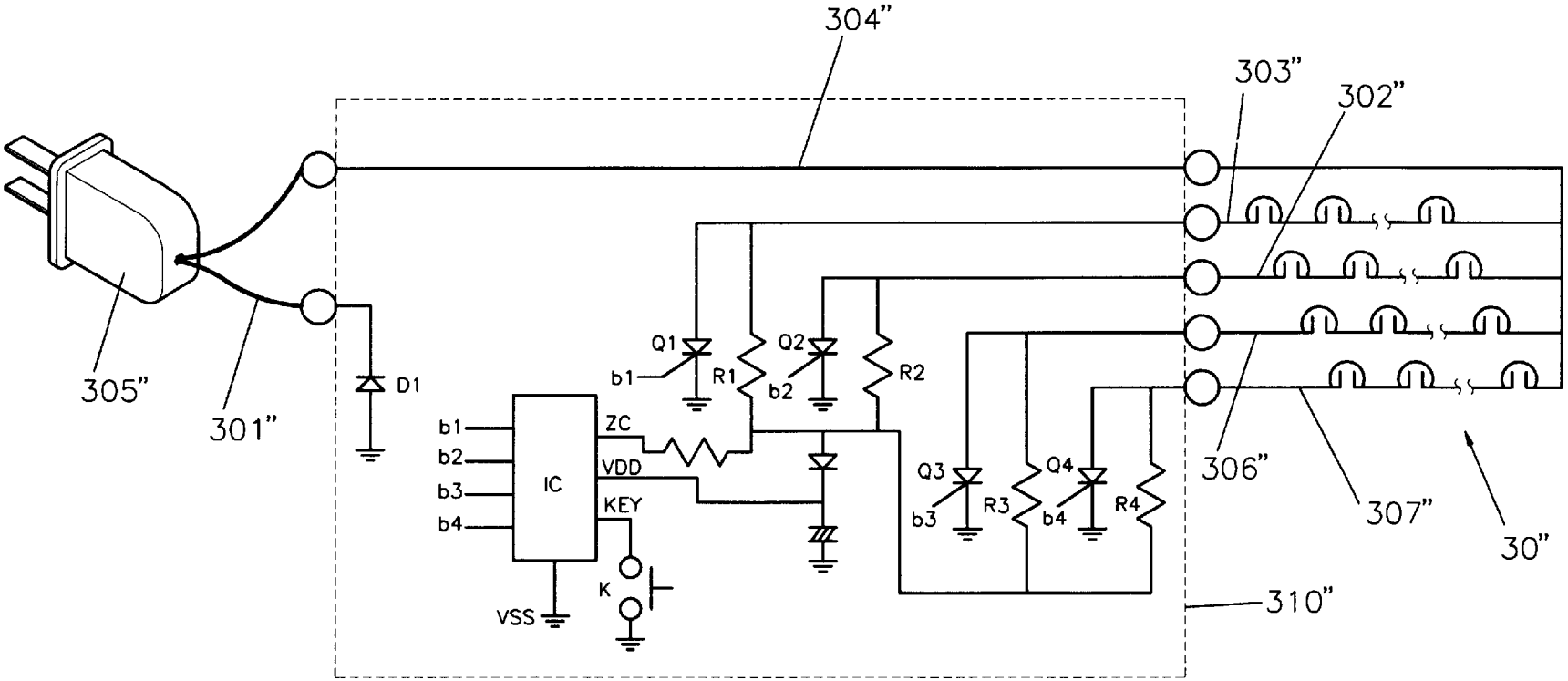
FIG. 8 is an electric schematic view of an electric circuit of a decoration lamp string device of a third preferred embodiment.
Figure 8A:
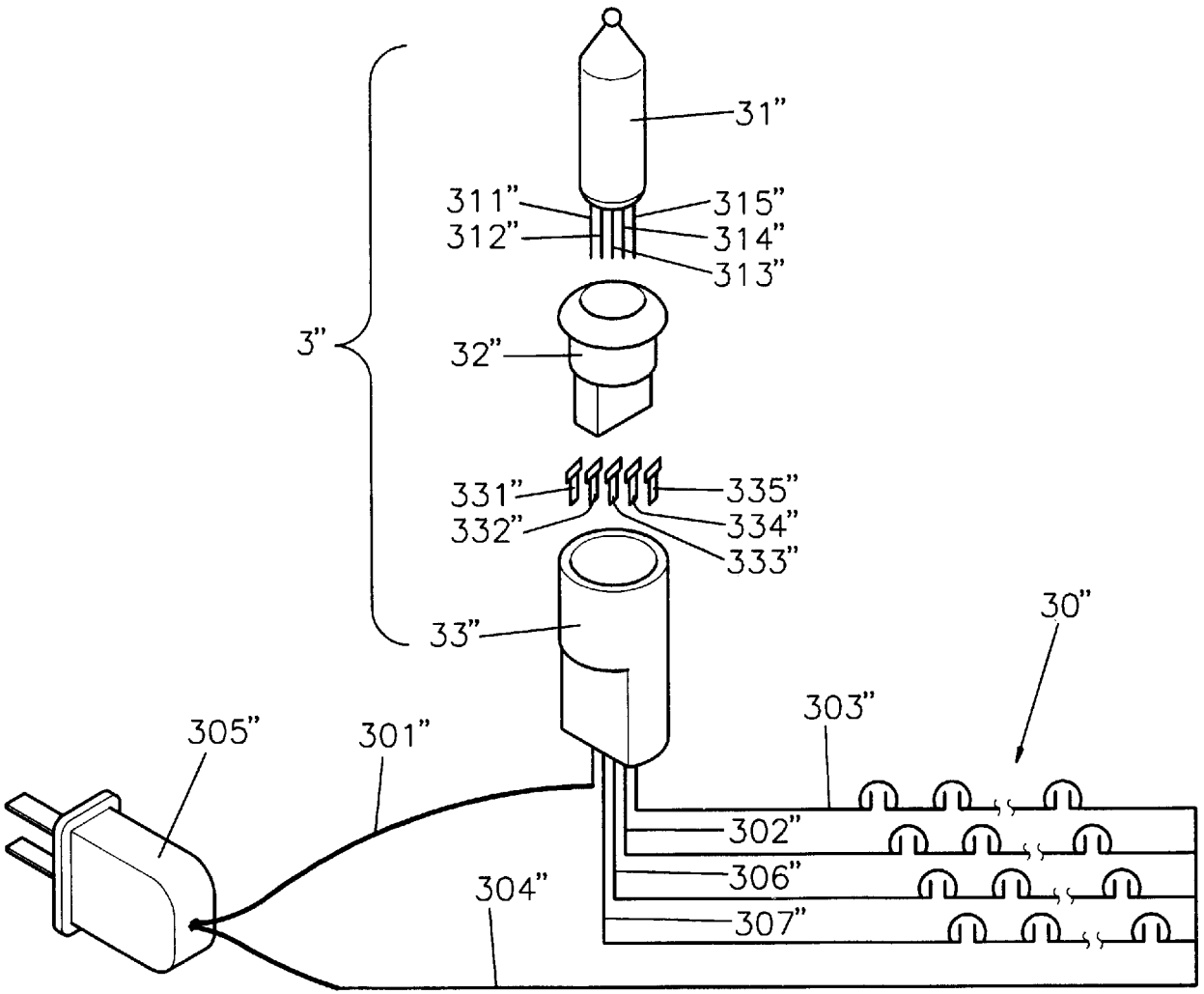
FIG. 8A is an electric schematic view of an electric circuit of a decoration lamp string device of a third preferred embodiment with a perspective exploded view of a bulb-type control device.

Referring to FIGS. 8 and 8A, a third decoration lamp string device comprises a lamp type control device 3", a plug 305", and a lamp string 30".

The lamp type control device 3" comprises a bulb type main body 31", a lamp holder 32" receiving the bulb type main body 31", and a socket 33" receiving the lamp holder 32". An electric circuit 310" is disposed in the bulb type main body 31". A first lead-in wire 311", a second lead-in wire 312", a third lead-in wire 313", a fourth lead-in wire 314", and a fifth lead-in wire 315" are extended from an interior of the bulb type main body 31".

A first electric wire 301" is connected to the plug 305" and the socket 33". A second electric wire 304" is connected to the plug 305" and the lamp string 30'.

The lamp string 30" comprises a plurality of decoration lamps, a third electric wire 302", and a fourth electric wire 303", a fifth electric wire 306", and a sixth electric wire 307".

A first copper post 331" is connected to the first lead-in wire 311" and the first electric wire 301". A second copper post 332" is connected to the second lead-in wire 312" and the third electric wire 302". A third copper post 333" is connected to the third lead-in wire 313' and the fourth electric wire 303". A fourth copper post 334" is connected to the fourth lead-in wire 314" and the fifth electric wire 306". A fifth copper post 335" is connected to the fifth lead-in wire 315" and the sixthth electric wire 307".

Figure 9:
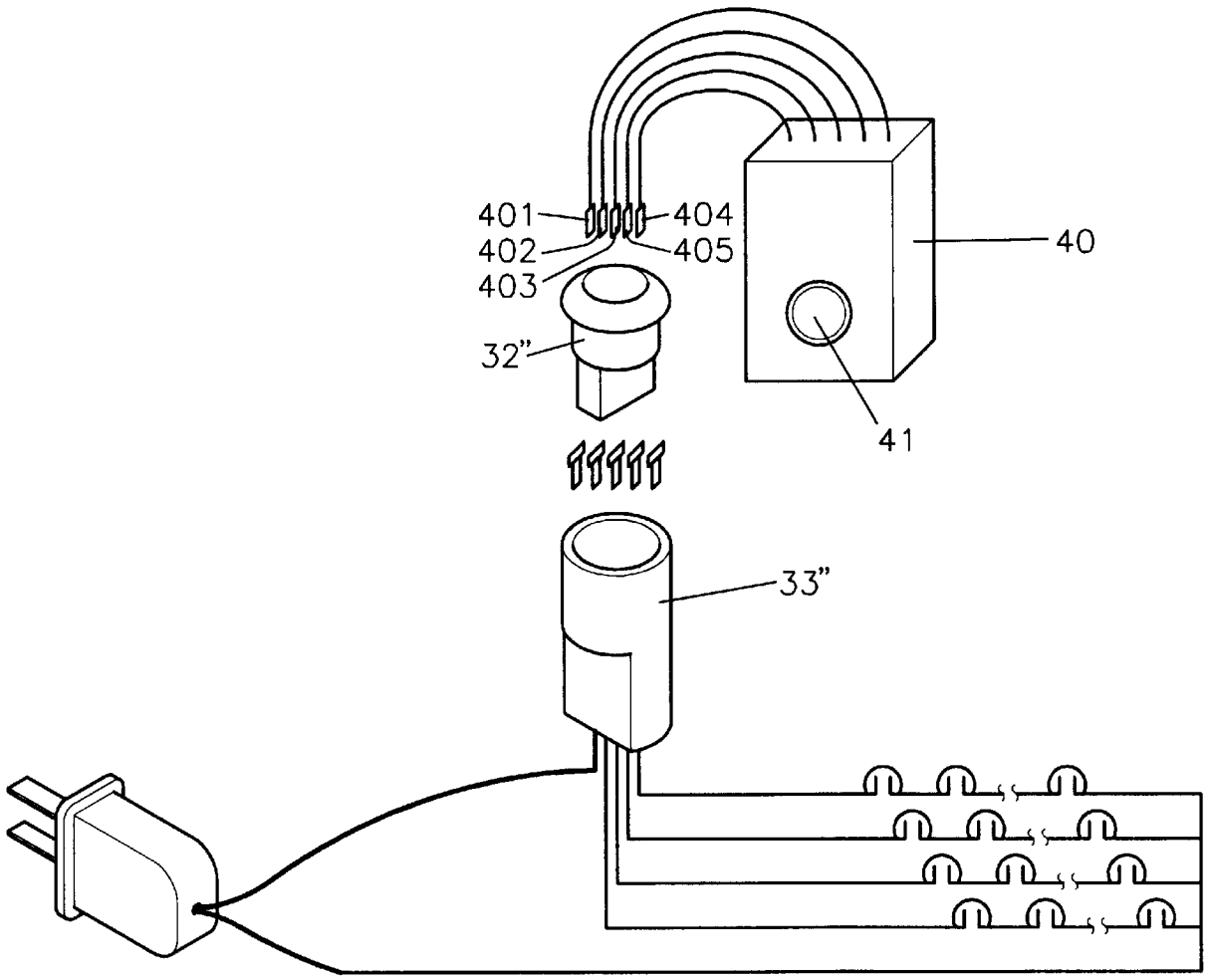
FIG. 9 is an electric schematic view of an electric circuit of a decoration lamp string device of a fourth preferred embodiment with a perspective exploded view of a control box, a lamp holder, and a socket.

Referring to FIG. 9, a fourth decoration lamp string device comprises a control device 40, a button 41 disposed on the control device 40, a lamp holder 32", and a socket 33" receiving the lamp holder 32". The control device 40 is connected to five wires 401, 402, 403, 404, and 405.

The shape of the lamp type control device can be replaced by various shapes.

I claim:

1. A decoration lamp string device comprising:

a certain shape control device, a plug, and a lamp string, the certain shape control device comprising a bulb-shaped, a lamp holder receiving a bulb-shaped main body, and a socket receiving the lamp holder, an electric circuit disposed in the bulb-shaped main body, a first lead-in wire, a second lead-in wire, and a third lead-in wire extending from an interior of the bulb-shaped main body, a first electric wire connected to the plug and the socket, a second electric wire connected to the plug and the lamp string, the lamp string comprising a plurality of decoration lamps, a third electric wire, and a fourth electric wire, a first copper post connected to the first lead-in wire and the first electric wire, a second copper post connected to the second lead-in wire and the third electric wire, and a third copper post connected to the third lead-in wire and the fourth electric wire.

2. A decoration lamp string device as claimed in claim 1, wherein the electric circuit comprises an integrated circuit (IC), a first rectifier (D1) as a half-wave rectification, a second rectifier (D2) as a half-wave rectification, a first silicon control rectifier (Q1), a second silicon control rectifier (Q2), a (ZC) symbol providing 60 HZ of electric source for the integrated circuit (IC), a capacitor (C1) as a wave filter capacitor, a button switch (K) connected to the integrated circuit (IC), a (VDD) symbol providing positive voltage for the integrated circuit (IC), a (VSS) symbol providing negative voltage for the integrated circuit (IC), a (KEY) symbol selecting various flash functions, a (b1) symbol providing an operation signal for the rectifiers, and a (b2) symbol providing a non-operation signal for the rectifiers.

* * * * *